US005950253A

United States Patent [19]

Last

[11] Patent Number: 5,950,253

[45] Date of Patent: Sep. 14, 1999

[54] TRACK ASSEMBLY FOR FLEXIBLE ENCLOSURE COVERS

[76] Inventor: Harry J. Last, 122 Duncrest Ave., Monterey, Calif. 93940

[21] Appl. No.: 09/206,179

[22] Filed: Dec. 4, 1998

Related U.S. Application Data

[62] Division of application No. 08/844,893, Apr. 22, 1997, Pat. No. 5,845,343.

[51] Int. Cl.[6] ..... E04H 4/10

[52] U.S. Cl. ..... 4/502; 4/503; 160/273.1

[58] Field of Search ..... 4/500, 502, 503; 160/272, 273.1

[56] References Cited

U.S. PATENT DOCUMENTS 2,731,220 1/1956 Power ..... 160/273.1 X
4,811,433 3/1989 McDonald et al. ..... 4/502

*Primary Examiner*—Robert M. Fetsuga
*Attorney, Agent, or Firm*—Robert J. Schaap

[57] ABSTRACT

A track assembly for allowing movement of a flexible enclosure cover over an area to be enclosed as, for example, a body of water in a swimming pool. The assembly comprises a pair of spaced apart tracks mounted on opposite sides of the area to be enclosed with each being comprised of an elongate strip. Each track strip comprises a cable receiving channel with a gutter or debris trough located generally beneath the channel for collection of debris. Preferably, a slider can be located in the cable receiving channel for locking to the cable and for securement of the cover to the cable. The track can be constructed to also allow for lubrication of the cable receiving channel anabling a slider mechanism to freely move therein. When a slider is used, it extends into each channel at approximately a 45° angle with respect to a vertical direction. In accordance with this construction, debris which might otherwise collect in the cable receiving channel will drop into the gutter and will not interfere with movement of the slider mechanism or the leading edge of the cover. The slider may be adjustably secured to a rigid body which is, in turn, secured to the leading edge of the cover, and which allows side-to-side adjustment of the leading edge. Adjustment in the 45° angulated plane could reduce bending moment forces on the slider and track.

30 Claims, 5 Drawing Sheets

TRACK ASSEMBLY FOR FLEXIBLE ENCLOSURE COVERS

RELATED APPLICATION

This application is a division of my co-pending U.S. patent application Ser. No. 08/844,893, filed Apr. 22, 1997, now U.S. Pat. No. 5,845,343, and entitled "TRACK ASSEMBLY FOR FLEXIBLE ENCLOSURE COVERS".

BACKGROUND OF THE INVENTION

1. Field of the Invention

This invention relates in general to certain new and useful improvements in track assemblies for moving flexible enclosure covers over an area to be enclosed and more particularly to an assembly of the type stated which allows for collection of debris in the tracks and which also permits adjustable positioning of the leading edge of the cover with respect to the tracks.

2. Brief Description of the Related Art

In recent years, automatic swimming pool cover system have become quite popular with both residential pool owners and commercial swimming pool operators. These automatic pool cover systems are preferred over conventional manually movable covers inasmuch as they are effective in precluding the collection of debris in the swimming pool and reduce the frequency and amount of pool maintenance which would otherwise be required. In addition, they provide a significant safety factor in that the construction is such that one or more individuals may literally walk on the pool cover while it is extended over a swimming pool body of water. Further, these swimming pool covers are effective in that they reduce heat loss and further can actually increase water temperature through solar effects.

The commercially available swimming pool cover systems usually employ a powered reel upon which a flexible swimming pool cover is rolled. A pair of tracks are mounted on opposite sides of the swimming pool and the leading edge of the cover is connected to a motor driving the reel through a cable arrangement. U.S. Pat. No. 5,349,707, dated Sep. 27, 1994, to Harry J. Last, and U.S. Pat. No. 4,393,798, dated Jul. 10, 1990, to Harry J. Last, are representative of pool covers of this type. Alternate types of assemblies are shown in U.S. Pat. No. 4,464,801, dated Aug. 14, 1984, to Joe H. Lamb, and U.S. Pat. No. 4,466,144, dated Aug. 21, 1984, to Joe H. Lamb.

When the swimming pool cover is to be advanced to a position where it closes off the swimming pool, the cable arrangement will pull the leading edge of the cover until the cover fully extends over the swimming pool. The sides of the cover are mounted on the cables which move within the tracks mounted at the opposite sides of the swimming pool. When sliders are used, the cover is secured to the sliders which are, in turn, secured to the cables. In like manner, when it is desired to remove the swimming pool cover, the motor causes the reel to rotate in a reverse direction and thereby wind the cover onto the reel. Otherwise, a pair of motors may be employed for this purpose.

The tracks which are used to receive the sliders on the sides of the swimming pool covers usually contain a track receiving channel with a slit on a surface of the track leading into the channel. The slider contains a strip which extends through this elongate relatively narrow slit into the channel and on its inner end has a circular tube or so-called "guide" which rides within the slider mechanism receiving channel in the track. In this way, the slider is precluded from moving outwardly from the track and allows for sliding movement of the cover along the track.

Track constructions of the foregoing type are illustrated and described in U.S. Pat. No. 3,060,455, dated Oct. 30, 1962, to Joe H. Lamb, U.S. Pat. No. 3,979,782, dated Sep. 14, 1976, to Joe H. Lamb, and U.S. Pat. No. 4,939,798, dated Jul. 10, 1990, to Harry J. Last.

However, debris, such as twigs, leaves, dirt and the like, readily collects within this track receiving channel, and which will ultimately materially interfere with the movement of the slider within the channel. In fact, in many cases where the swimming pools are located near a large number of trees, and particularly pine trees, the collected debris including pine needles and cone fragments can actually cause the slider to literally jam within the track. This requires the pool owner or an attendant to literally get on his or her hands and knees and attempt to manually clean out the track to free the slider mechanism.

Another one of the problems associated with the tracks normally used with the automatic pool cover systems is the fact that there is essentially no means to enable a lubricant to remain within the track as the slider moves within the cable receiving channel. In these conventional slider track assemblies, the slider tends to literally push any lubricant out of an end of the cable receiving channel. Accordingly, the pool owner or a pool attendant or other maintenance personnel must periodically introduce a lubricant into the slide receiving channel.

There have also been several attempts to mount a track on the side of and flush with the upper surface of a deck. This is oftentimes desirable when obstacles may exist on the deck at or adjacent to the edge of the swimming pool, or otherwise, where surface mounted tracks adjacent to pool might otherwise interfere with pool side activities or the like. These so-called "flush mounted tracks" are usually located within a groove formed in the surface of the deck adjacent to a side of the pool.

In the flush mounted track systems, the flexible cover must be angulated at the edge of the track for extending into the cable receiving channel and for securement to the cable in that channel. This type of construction thereby causes extensive wear. very rapidly on the cover itself. For this purpose, sliders are preferably employed. However, and here again, when the cover is secured to the slider, a substantial torque is imposed on the slider, and this torque imposes a bending force on the track.

Further, inasmuch as a slider must extend upwardly from a flush mounted track and is angulated with respect to a horizontal plane, additional forces are imposed on the track system. Typically, in this construction, sliders extend outwardly from the tracks and are connected to leading edges of the swimming pool cover. As such, the sliders are forced upwardly and downwardly as the cover is forced upwardly and downwardly in a vertical plane. This vertical shifting movement introduces a twisting moment on the leading edges of the pool cover and is imparted to the cable securing tube of the slider, or so-called "slider tube", which operates in the bulbous portion of the track, as the leading edge of the pool is raised and lowered. There has been some need for a means to enable a sideways adjustment in the horizontal plane and to provide for an adjustable positioning of the slider mechanism relative to the track.

In many commercial swimming pools, the swimming pool covers must traverse a fairly substantial width, and moreover are unsupported in this dimension across the width of the swimming pool. The leading edge of the swimming pool cover, by virtue of its weight over this large distance, can impose a substantial force on the track assemblies, and moreover, cause a bending moment on the track assemblies. In order to support this additional load, roller assemblies have been proposed. However, these roller assemblies are generally not effective for their intended purpose.

In addition, and in an effort to support the load at the leading edge of a swimming pool cover, so-called "floating leading edges" have been employed. However, these edges again impart a twisting moment to either the cable or otherwise to the slider, and hence, may cause premature wear to the sliders and to the tracks.

Additional swimming pool cover assemblies are shown in the prior art as, for example, in U.S. Pat. No. 5,067,184, dated Nov. 26, 1991, to Harry J. Last, and also in U.S. Pat. No. 4,466,143, dated Aug. 21, 1984, to Joe Lamb, and in U.S. Pat. No. 3,979,782, dated Sep. 14, 1976, to Joe H. Lamb. Cover systems are also shown in United Kingdom Patent Application No. 2,072,006A, and Canadian Patent No. 1,046,706. However, none of these slider track arrangements solve the specific problems identified herein.

OBJECTS OF THE INVENTION

It is, therefore, one of the primary objects of the present invention to provide a track assembly in which debris collection and retention in a cable receiving channel of a track is eliminated, thereby reducing impediments to free movement of the cable or a slider in the cable receiving channel of the tracks.

It is another object of the present invention to provide a unique track which is provided with a debris collection trough such that any debris which collects in the cable receiving channel can be automatically pushed and dropped into this debris collecting trough and ultimately It is a further object of the present invention to provide a cable receiving track of the type stated in which groves are formed on the interior bore of the cable receiving channel to receive and retain a lubricant and thereby impart lubricant in the bore of the track and which is not otherwise achievable with a smooth bore.

It is also an object of the present invention to provide a track assembly for use with covers extending over areas to be enclosed and which allows for a slider plate to operate at a position angulated from a horizontal plane and which also enables compensation for any twisting moments imparted to a slider tube operating in the slider receiving channel.

It is still a further object of the present invention to provide a track assembly of the type stated in which adjustable positioning of a slider relative to the track can be achieved, and which enables sideways adjustment in a horizontal plane.

It is still another object of the present invention to provide a track assembly of the type stated in which wheels could be provided in heavy duty applications and with an angulated plate providing an adjustment to ensure that the wheels and sliders are maintained in a perfect relationship.

It is an additional object of the present invention to provide a track and slider assembly of the type stated in which a floating leading edge of a swimming pool cover can be supported across a substantial width.

It is yet another salient object of the present invention to provide a track assembly, as well as a track and slider arrangement of the type stated which can be constructed at a relatively low cost and which is highly reliable in operation.

With the above and other objects in view, my invention resides in the novel features of form, construction, arrangement and combination of parts presently described and pointed out in the claims.

BRIEF SUMMARY OF THE INVENTION

The present invention broadly relates, in one aspect, to a track for use with a flexible cover capable of being moved over an area to be enclosed. The improved track of the invention includes a separate debris collection trough which allows for collection of debris and which would otherwise collect in the cable receiving channel of the track and thereby interfere with the free movement of the cable or a slider mechanism used in the cable receiving channel.

In one embodiment of the invention, the track is in the form of an elongate strip having means for mounting the strip adjacent an edge of the area to be covered. A cable receiving channel is formed in this elongate strip and is sized and shaped to receive a cable capable of pulling the leading edge of the cover to a fully extended or closed position. The cover is secured to the cable adjacent the leading edge thereof. However, a slider may be used in the cable receiving channel and is provided with means for attaching to the cable and the cover and moving the leading edge of the cover during a cover extending operation, that is, where the cover extends over the area to be covered.

The cable receiving channel of the track generally includes a somewhat bulbous or enlarged portion sized to receive a cover pulling cable. Again, when a slider is used, the slider has an inner cable attaching tube which is sized to move within the bulbous or enlarged portion of the track. Usually, although not necessarily, this enlarged or bulbous portion is cylindrically shaped, although it may be rectangularly shaped or otherwise of other cross-sectional shape.

The edges of the cover are thereupon secured to either the cable or an outer portion of the slider or so-called slider plate. In this way, as the slider moves within the track, it will pull the leading edge of the cover with it.

In the improved track of the invention, a recess or trough is located beneath the cable receiving channel and forms a type of gutter located to receive the debris which might otherwise collect in the cable receiving channel. This gutter is typically located beneath the cable receiving channel, and when debris falls into the cable receiving channel, it is allowed to drop through an opening into the gutter. However, the cable or otherwise the attachment tube on the lower end of the slider will remain within the slider receiving channel.

Debris can be removed from the gutter or trough by literally causing movement of the debris to one end of the track. In a more preferred embodiment, the track is used as part of a swimming pool cover system. In this case, a pair of tracks are used on opposite sides or adjacent edges of the swimming pool and the area to be enclosed would be the body of water contained within the swimming pool. Thus, and for this purpose, the cover is frequently referred to as a "swimming pool cover".

Each of the tracks is provided with means for mounting the track in a position adjacent the edge of the body of water in the swimming pool. In many cases, the tracks can be so-called "flush mounted tracks", that is, they are mounted adjacent the deck of the swimming pool and have upper surfaces which are flush with the upper surface of the deck.

Each of the tracks used in the track assembly of the present invention comprises the elongate strip, usually formed of a metal and preferably a light-weight metal, such as aluminum. The strip usually includes an upper plate and the cable receiving channel is located beneath this upper plate. However, when a slider is used, a slider receiving slit is provided in the upper plate and communicates with the cable receiving channel. This slit allows for a slider neck to extend into the cable receiving channel. Further, the elongate track strip also includes an opposite cable return channel to receive a separate cable or a return of the same cable for moving the flexible cover. The cable return channel runs essentially parallel to the cable receiving channel.

In a preferred embodiment of the invention, a slider is used and extends outwardly from the cable receiving channel at an angle which is displaced upwardly from the horizontal and at an angle which approaches approximately a 45° angle. That angle can range, however, from about 20° to about 65°. Moreover, and in a preferred embodiment of the invention, the opening between the cable receiving channel and the debris collecting trough is also offset from a bottom portion of the channel, such that the opening to receive the debris from the cable receiving channel and the slit which accommodates the neck of the slider lie in the same plane relative to the track and angularly displaced from the horizontal. As indicated previously, the slider and the opening are therefore located at approximately a 45° angle relative to a true horizontal plane and a true vertical plane.

This construction is highly effective in that it will preclude any debris which might otherwise collect in the cable receiving channel from causing a jamming of either the cable or the slider if a slider is used. The debris will normally be allowed to fall into the debris collecting trough located therebeneath. In fact, as the cable is moved within the cable receiving channel, it will literally cause a movement of the debris and push the same downwardly into the debris collecting trough. When a slider is used, it will also have the same effect and effectively push the debris downwardly into the debris collecting trough.

The debris which collects in the trough can be easily and readily cleaned on a periodic basis by pushing a plunger through an end of the debris collecting trough so that the debris is literally pushed out of the opposite end thereof. The debris may also be removed from the debris collecting trough by using water from a garden hose under pressure to literally flush the same from the gutter.

In another aspect of the present invention, lubricating grooves are literally formed in the interior surface of the cable receiving channel. As indicated previously, this channel has a tubular bulbous portion such as a cylindrically shaped bulbous portion and these elongate grooves are preferably located in the bulbous portion. These grooves operate in a manner somewhat similar to bearing sleeves and retain a lubricant for imparting and holding a lubricant on the wall of the cable receiving channel.

In another aspect of the invention, there is a track and slider assembly allowing for sliding movement of the leading edge of a swimming pool cover over a body of water in the swimming pool and with the tracks of the assembly in a position where they are generally flush with the deck of the swimming pool. In this case, a pair of spaced apart elongate tracks are mounted to the opposite sides of the swimming pool in a generally parallel relationship.

A cable receiving channel is formed in each of the elongate tracks, at aforesaid, and a separate slider extends into a separate cable receiving channel in each track. This allows for sliding movement of the slider within the channel. Moreover, as the slider moves within the channel it will cause a pulling of the leading edge of the swimming pool cover.

In another embodiment of the invention, a separate rigid body, often referred to as a "slider body", is mounted on and is movable with each slider. This slider body carries with it a slider plate and the leading edge of the swimming pool cover is secured to this sliding plate. Further, adjusting means are provided to enable an adjustable sliding movement of the slider body relative to the slider during movement of the slider in the track. This adjusting enables a reduction in the twisting moment force imposed on the slider strip during the pulling of the cover and also thereby reduces any possibility of jamming.

The track and slider assembly in this aspect of the invention also uses that improved slider receiving track of the type previously described. Moreover, that track will normally contain a gutter or trough to collect the debris which would otherwise tend to collect in the cable receiving channel. As indicated previously, the slider extends outwardly from the track at about a 45° angle or at very minimum at an angle elevated with respect to a true horizontal plane. In this way, the slit lies in a common plane with the opening leading into a trough at roughly about a 45° angle.

The adjusting means which is used to adjust the sliding movement of the rigid body relative to the slider comprises an elongate pin receiving slot in one of the rigid body or the slider and a pin on the other in order to enable a sliding movement therebetween. In a preferred embodiment, a bolt would be provided for extension through an elongate slot in one of the rigid body or the slider. Adjustable locking of the bolt but yet in a position where it is not fully locked would still allow some movement between the rigid body and the slider thereby compensating for the moment arm or twisting moment imparted to the attachment tube by the leading edge of the cover as the slider moves within the track. A second bolt could also be provided to enable a sideways adjustment in a horizontal plane and thereby provide a proper sliding fit.

In another embodiment of the invention, and particularly with heavy duty applications, wheels can be added to a bracket on the rigid body. In this construction, the 45° angled plane of the slider would serve as a means to provide adjustment to ensure that the relationship of the wheels and the sliders are maintained in order to prevent jamming.

In yet another embodiment of the invention, by elimination of the wheels from the bracket and allowing both of the sides of the swimming pool cover to slide somewhat, the entire assembly can be used to compensate for water level variation with the 45° angle adjustability. The same mechanism would also provide for side-to-side variations for a floating leading edge application, as also hereinafter described in more detail.

This invention possesses many other advantages and has other purposes which may be made more clearly apparent from a consideration of the forms in which it may be embodied. These forms are shown in the drawings forming a part of and accompanying the present specification. They are also described in more detail in the following detailed of the description of the invention. However, it is to be understood that this following detailed description and the accompanying drawings are set forth only for purposes of illustrating the general principles of the invention and are not to be taken in a limiting sense.

BRIEF DESCRIPTION OF THE DRAWINGS

Figure 1:
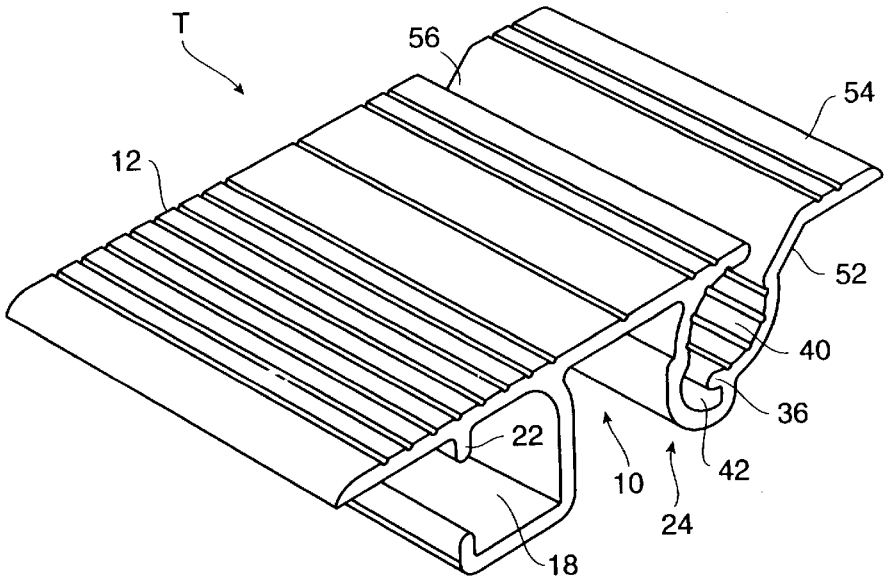
Figure 2:
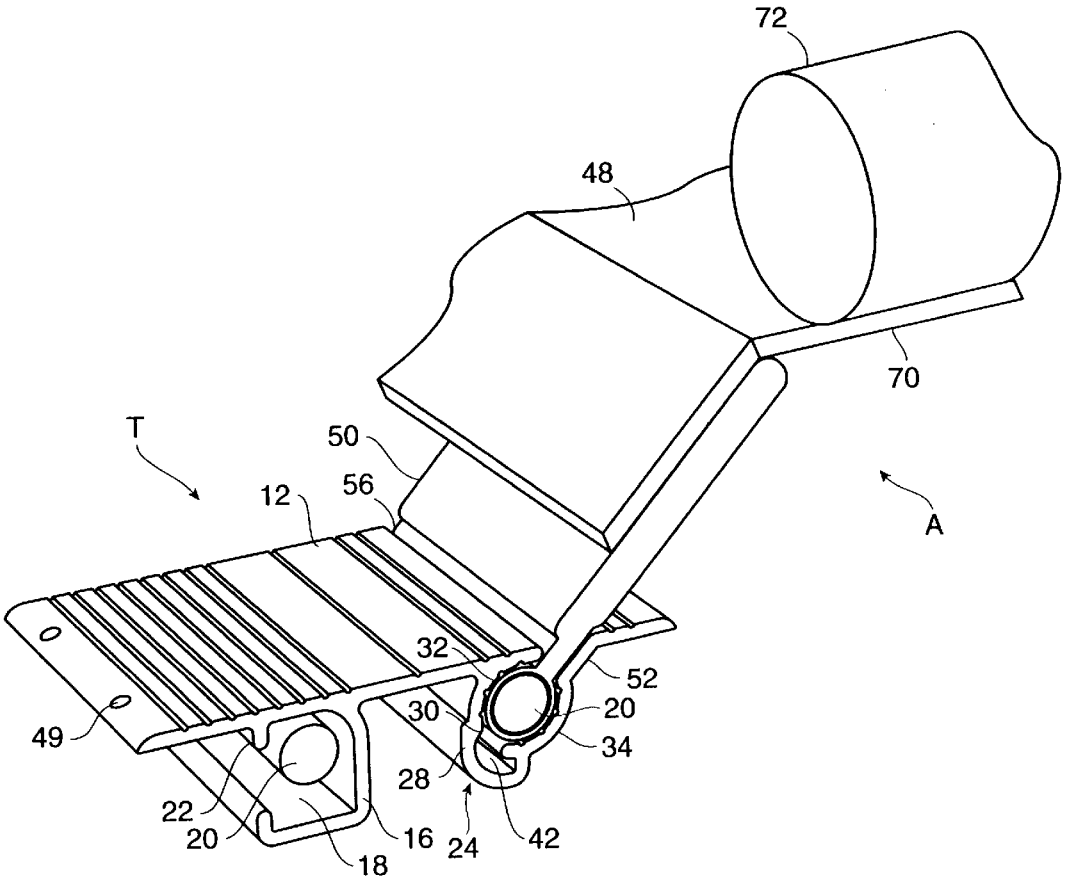
Figure 3:
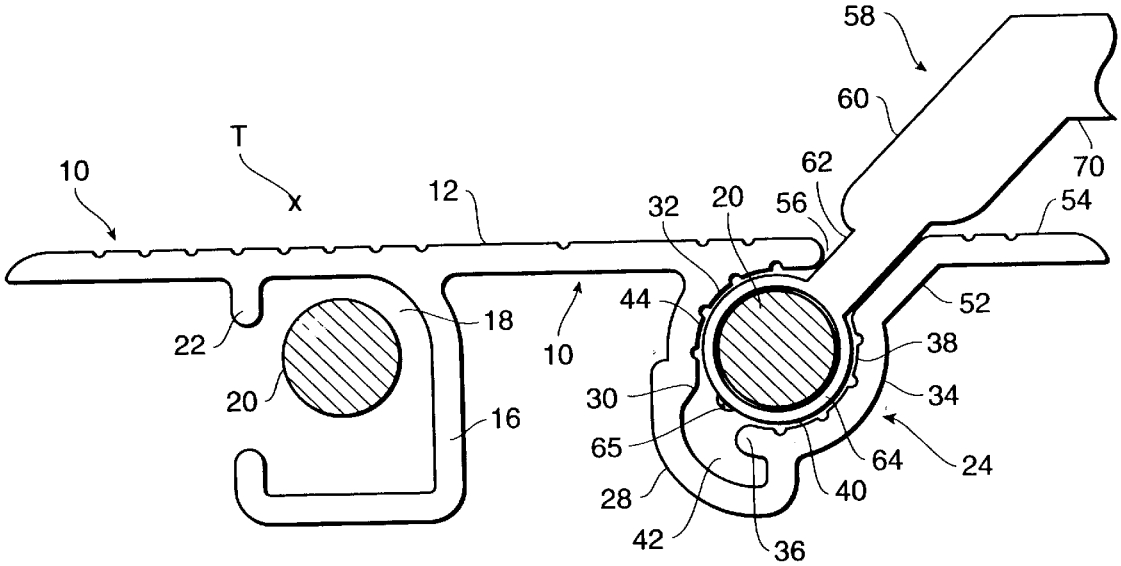
Figure 4:
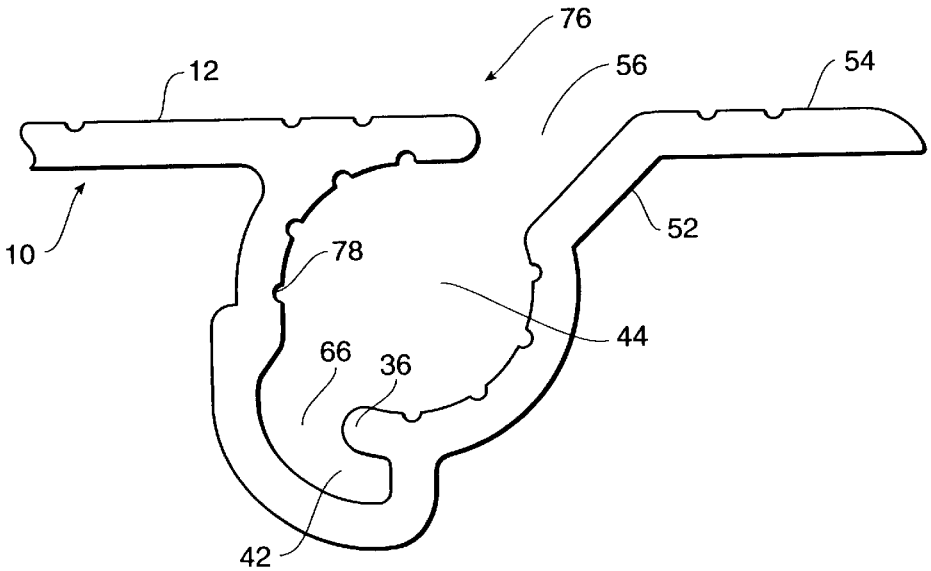
Figure 5:
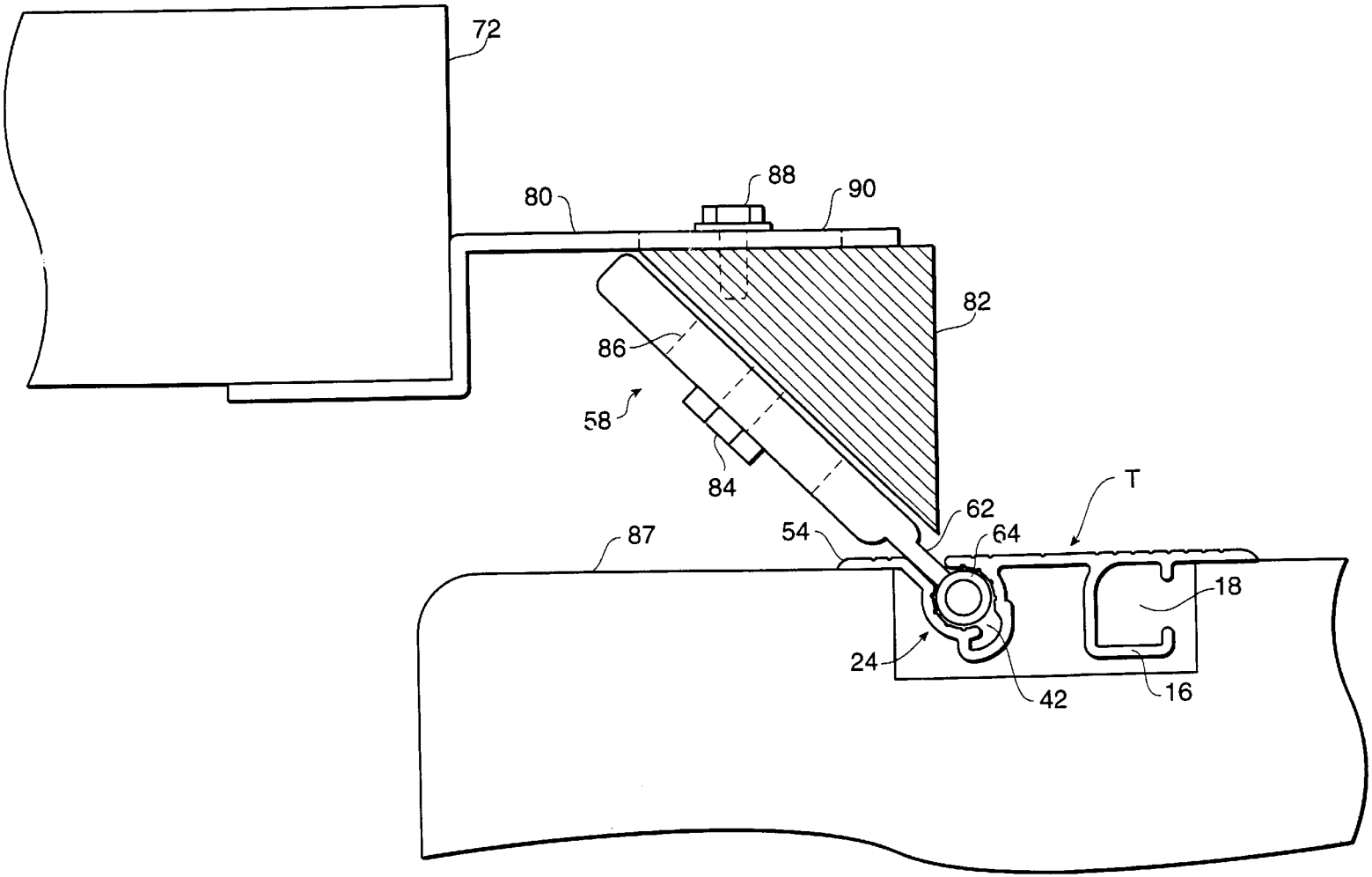
Figure 6:
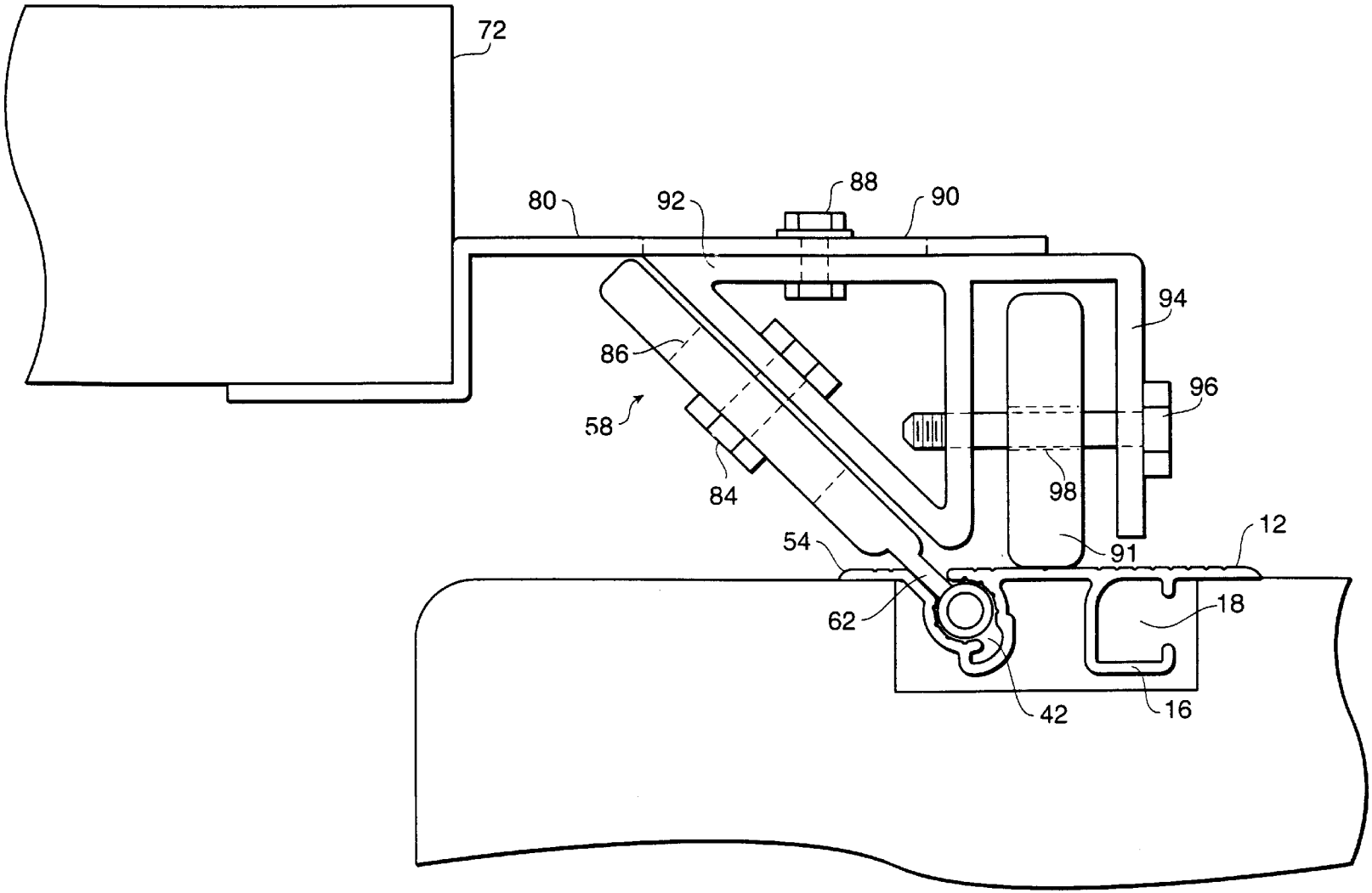
Figure 7:
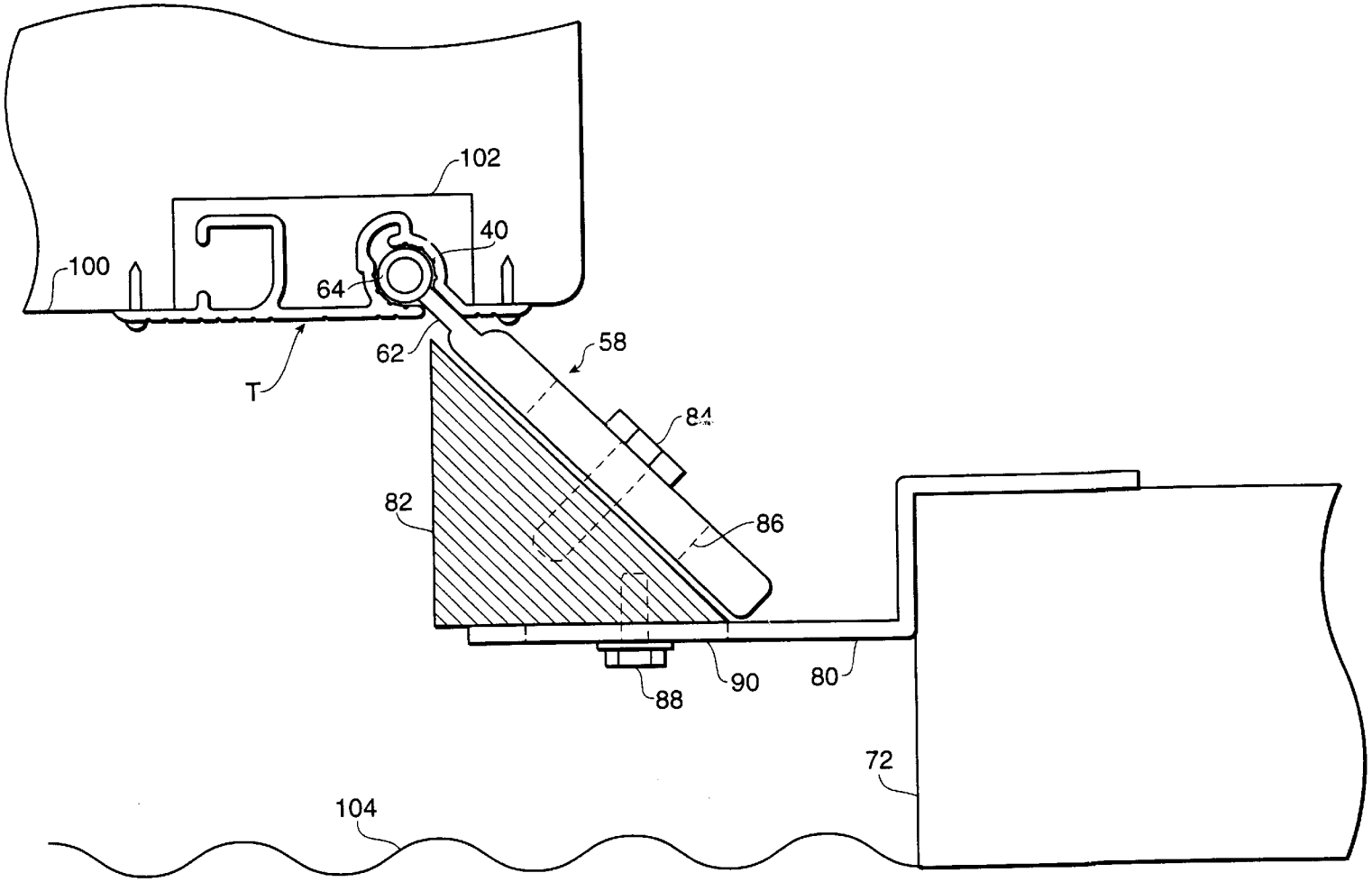

Having thus described the invention in general terms, reference will now be made to the accompanying drawings in which:

FIG. 1 is a fragmentary perspective view of a portion of a track constructed in accordance with and embodying the present invention;

FIG. 2 is a fragmentary perspective view of a portion of a track and a slider in the track and carrying the leading edge of a swimming pool cover;

FIG. 3 is an enlarged end elevational view, partially in section, of the track of FIG. 1 with a slider extending into a slider receiving channel of the track;

FIG. 4 is an enlarged end elevational view of a portion of a modified form of track constructed in accordance with and embodying the present invention;

FIG. 5 is an end elevational view of a portion of another modified form of slider and track assembly constructed in accordance with and embodying the present invention;

FIG. 6 is an end elevational view, partially in section, and showing another modified form of slider and track assembly, which uses supporting wheels and which is constructed in accordance with and embodying the present invention; and FIG. 7 is an end elevational view of still a further modified form of slider and track assembly, using a floating leading edge arrangement, and which is constructed in accordance with and embodies the present invention.

DETAILED DESCRIPTION OF A PREFERRED EMBODIMENT

Referring now in more detail and by reference characters to the drawings, which illustrate several preferred embodiments of the invention, FIG. 1 illustrates a portion of a track T used with a swimming pool cover, more fully illustrated in FIG. 2 of the drawings.

The track T of the present invention generally includes an elongate strip 10, preferably formed of aluminum or other lightweight metal, although other materials of construction could be employed, as, for example, plastics, reinforced plastics, or other rigid materials of construction.

The elongate strip 10 has an upper plate 12 which is relatively flat, as best shown in FIGS. 1 and 2 of the drawings. The plate 12 on its underside is provided with a somewhat U-shaped depending channel-forming wall 16, forming a return cable channel 18, which is sized to receive a cable 20, and which may be a return of another cable, as hereinafter described in more detail. This cable is capable of being operatively connected to the leading edge of the cover and pulling same within the track during movement of the cable 18. A depending tab 22 extends downwardly from the underside of the top wall 12 and partially encloses the channel 18 to retain the cable 20 therewithin. However, the tension on the cable usually retains this cable within the channel in any event.

Along its opposite longitudinal side, the elongate strip 10 of the track T is provided with an integrally formed depending cable receiving channel-forming wall 24. The channel-forming wall 24 is constructed, as best shown in FIG. 3, with somewhat of an arcuately shaped left-hand side 28, reference being made to FIG. 3, and which integrally includes an integrally formed inwardly projecting boss 30, which forms a first somewhat arcuately shaped inner wall surface 32. The channel-forming wall 24 is also provided with a right-hand side 34, which also includes a lower flange 36, thereby forming an inwardly presented arcuately shaped surface 38. The arcuate surfaces 32 and 38 combine to effectively form a generally cylindrically shaped cable receiving bore, or channel 40, all as best shown in FIG. 3 of the drawings.

By further reference to FIG. 3, it can be seen that the construction of the channel-forming wall 24, along with the boss 30 and the flange 36, also form a lower trough or gutter 42 for receiving debris which might otherwise collect in the cable receiving channel 40 formed by the wall 24. This cable receiving channel 40 also receives a portion of the cable which may be trained around a pulley (not shown). Otherwise, the cable, receiving channel 40 could receive a separate cable forming part of the cable system for moving the fabric cover.

In accordance with this above-identified construction, it can be seen that the trough 42 is located generally beneath the channel 40 formed by the channel-forming wall 24. This channel 40 includes a generally cylindrically shaped somewhat bulbous portion 44. This bulbous portion 44 is that portion of the cable receiving channel 40 which is sized to receive a cable such as the cable 20. Normally, this cable 20 generally fits snugly, but nevertheless slidably within the cable receiving channel. Moreover, in the embodiment as shown, the cable receiving channel 40 is cylindrically shaped. However, it should be understood that this channel could also be formed of other shapes, such as a rectangular shape, or the like.

The track of the present invention may be used readily with a cable secured directly to a fabric cover 48. However, it may also be used in connection with a slider 50, also shown in FIG. 2. In many cases, some swimming pool cover manufacturers will prefer to secure the leading edge of the cover 48 directly to the cable itself. However, in order to ensure a better sliding movement of the leading edge of the cable, many pool cover manufacturers will use a slider 50, as shown in FIG. 2.

The track may also be provided with a means for mounting the track to a deck adjacent to a swimming pool. One conventional means for mounting would be a plurality of screw holes 49 in the edge of the track for securing same to the edge of a deck. The screw holes could be located elsewhere on the track. Further, other conventional means of mounting may also be provided.

The track T of the present invention is uniquely designed to be used with those pool covers connected directly to the cable, or those covers which are connected to a slider, such as the slider 50, and which, in turn, is connected to the cable. For this purpose, the right-hand wall section 34 integrally merges into a diagonally arranged plate section 52, which is referred to as a bearing plate, and which, in turn, integrally merges into a relatively flat horizontally extending extension plate 54. By reference to FIG. 3, it can be observed that the extension plate 54 effectively serves as an extension of the top plate 12 but is spaced from the top plate 12 and thereby forms an elongate slit 56, sized to receive a slider 58.

Although the track of the invention can be used with a cover connected directly to the cable 20 by conventional means, and for purposes of more fully illustrating and describing the full range of utility of the invention, it will be described in connection with the use of a slider, such as the slider 58. Generally, the slider comprises a relatively flat plate section 60 which integrally merges into a reduced thickness neck 62, and which, in turn, is secured to an attachment tube 64, sometimes referred to as a "cable attaching tube". In the embodiment as shown in FIG. 3, it can be seen that the cable 20 is secured within the cable attachment tube 64 by means of a plurality of screws 65, or like fasteners.

By further reference to FIGS. 2 and 3 of the drawings, it can be observed that the cable attachment tube 64 is diametrally larger than an opening 66 leading from the lower portion of the slider mechanism receiving channel 40 and communicating with the trough 42. Moreover, the tube 64 is diametrally larger than the size of the slit 56 which accommodates the slider neck 62. In accordance with this construction, the tube 64 is physically restrained within the cable receiving channel 40, but afforded free sliding movement therein. Further, the neck 62 of the slider 58 is allowed to bear against the bearing plate 52, thereby supporting the slider 58 and precluding undue torque or rotational forces on the track.

In the embodiment of the slider, as shown in FIG. 2, the slider includes an extension or so-called "slider plate" 70, and in this case, the cover 48 has a leading edge 72 which is secured to the slider plate, all as best shown in FIG. 2 of the drawings. Moreover, the slider is secured to the cable 20 and therefore movement of the cable 20 will cause movement of the cover 48.

The leading edge 72 and also the pool cover 48 will typically span the complete width of the pool and will be located slightly above the water level. In this case, a pair of tracks are mounted on each of the opposite sides of the pool and this construction will thereby support the cover 48 as it is extended from a drum (not shown) and retracted onto the drum. The cables 20 which are typically formed of a plastic material are usually trained around pulleys (not shown) at the forward end of the track, that is the end which receives the cover when in a fully opened position, and also returns within the cable return channel 18. The actual mechanism for mounting of the swimming pool cover to the slider is not shown and reference is made to the aforesaid U.S. Pat. No. 4,939,798, dated Jul. 10, 1990, to Harry J. Last for that purpose.

FIG. 4 illustrates an embodiment of a modified form of track 76, which is similar to the previously described track T. However, in this case, the somewhat bulbous portion 44 is provided with a plurality of lubricating fluid receiving grooves 78. These lubricating grooves 78 are effective to retain a lubricating fluid, and provide a lubricated movement of either the cable or the slider within the cable receiving channel. The relatively smooth bore of the cable receiving channel is not effective to retain a lubricant in the same manner as these lubricating grooves 78.

FIG. 5 illustrates an embodiment of the invention in which a separate slider plate 80 is secured to the slider 58 through the use of a relatively rigid body 82. In this case, the rigid body 82 could be a plastic or wooden block or the like. Moreover, the track T is essentially of the same construction, as previously described. However, and although the track T would not necessarily have to include the gutter 42, it would preferably include this construction.

In the embodiment of the invention as shown in FIG. 5, the slider in this track and slider assembly is rotated approximately at a 45° angle relative to the deck 84 on which the track T is flush mounted. Moreover, it can be observed that the slider 58 is secured to the rigid body 82 by means of a bolt 84 which extends within an elongate slot 86 formed within the slider. In this way, adjustable positioning of the block 82 and hence the slider plate 80, can occur relative to the slider 58. Moreover, and by reference to FIG. 5, it can be observed that the slider plate 80 is secured to the rigid body 82 through another adjustment bolt 88, which extends through an elongate slot 90, formed in the slider plate. At its outer end, the slider plate 80 carries a leading edge, such as the leading edge 72.

In accordance with the construction as illustrated in FIG. 5, it can be seen that the bolt 88 extending through the elongate slot 90 enables a side-to-side adjustment of the leading edge 72. This is highly effective where there may be track-to-track variations, or otherwise, other types of skewed running conditions. The bolt 84 extending through the slot 86 allows for vertical positioning of the leading edge. It can be observed that when the slider 58 moves at a 45° angle or otherwise, an angle which is spaced from the horizontal, the leading edge 72 may be forced upwardly and downwardly in this vertical plane. The vertical movement of the leading edge 72 causes a moment arm or twisting movement imparted to the tube 64 operating in the cable receiving channel 40. The adjustable locking of the slider 58 to the rigid body 82 provides the necessary adjustment to compensate for this vertical shifting movement of the leading edge 72.

FIG. 6 illustrates a track and slider embodiment of the invention which is similar to that track and slider mechanism illustrated in FIG. 5, except that it includes the provision of wheels 91. In this embodiment of the invention, a rigid body 92 which is also somewhat triangularly shaped, is employed and carries an integrally formed inverted U-shaped bracket 94. The wheels 90 are carried in this U-shaped bracket 94 by means of a pin 96 and which extends through bearings 98 located in the wheels. This type of construction is highly effective for use with pools and moreover for use with covers imposing a heavy vertical load. It can be seen that this type of track and slider arrangement will work very effactively and much in the same manner as with the embodiment of FIG. 5. Moreover, it can also be observed that the wheels can ride directly on the top surface of the plate 12.

The 45° plane of the slider 58 also provides an excellent adjustment capability to ensure that the wheels and sliders are maintained in a perfect relationship to prevent jamming. A sufficient amount of play may be allowed with the adjustment bolts 84 and 88, as, for example, 0.010 to about 0.12 inches (0.25 to about 3.0 mm), to ensure this desired relationship.

It should also be understood that in place of the bolts extending through slots, other forms of adjustability could be provided. However, the use of the bolt and slot arrangement has been found to be effective in that it is relatively simple and inexpensive.

FIG. 7 illustrates an embodiment of a track and slider arrangement which is effective for use with a floating leading edge of a swimming pool cover. In this case, the assembly as shown in FIG. 5 can effectively be inverted. It can be seen that an overhang or coping on a deck is provided on its under surface with a groove 102 to receive a track T which is effectively inverted. In this case, the slider 58 extends downwardly and outwardly from a cable receiving channel 40 in the track. Inasmuch as the attachment tube 64 is effectively captured in this track, the slider 58 is retained in this position.

In the embodiment of the invention as shown in FIG. 7, the leading edge 72 is constructed as a floating tube or as a floating leading edge. In this case, it is effectively secured to the underside of the slider plate 80, as shown in FIG. 7. As the leading edge 72 rides along the surface of a body of water 104, it will bob up and down in a vertical direction. The adjustability provided by the adjustment bolts 84 in the slot 86 will compensate for this vertical shifting movement. Moreover, the adjustment bolt 88 moveable in the slot 90 will also compensate for side-to-side adjustment.

Thus, there has been illustrated and described a unique and novel track assembly for use with enclosure covers and also with slider and track assemblies which fulfills all the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention, are deemed to be covered by the invention.

Having thus described the invention, what I desire to claim and secure by letters patent is:

1. A track for moving a leading edge of a flexible cover over an area to be enclosed and allowing for withdrawing of the flexible cover from a position over the area to be enclosed, said assembly comprising:

a) an elongate track forming strip mounted adjacent an edge of the area to be enclosed;

b) a cable receiving channel in said elongate strip;

c) a cable slider extending into said cable receiving channel for sliding movement therein and having means to pull with it the leading edge of a flexible cover;

d) a recess located beneath said cable receiving channel in communication with said cable receiving channel and forming a gutter to collect debris and which is allowed to fall from the cable receiving channel into the gutter by force of gravity and by agitation through movement of the cable, and where the debris collected in the gutter is readily movable within the gutter to an open end of said gutter for removal therefrom; and e) an opening between said channel and said gutter enabling debris which enters said channel to drop by force of gravity and agitation through movement of the cable into said gutter so that the debris will not interfere with movement of the cable in the cable receiving channel of the track.

2. The track of claim 1 further characterized in that said track has an elongate slit in communication with said cable receiving channel to receive the slider.

3. The track of claim 1 further characterized in that the flexible cover is a swimming pool cover and the area to be enclosed is a body of water in the swimming pool.

4. The track of claim 1 further characterized in that said cable receiving channel comprises a bulbous portion to receive a somewhat similarly shaped attachment tube on the slider, which tube allows for attachment of the cable to the slider.

5. The track of claim 4 further characterized in that the opening is offset to one side of said cable receiving channel, and that said slider has a slider neck extending into said cable receiving channel at an angle which is angularly offset from a vertical direction while moving in said cable receiving channel.

6. The track of claim 5 further characterized in that said track has a bearing surface leading into the cable receiving channel and the neck of the slider is adapted to bear against and move along said bearing surface.

7. A track and slider assembly for allowing sliding movement of a leading edge of a swimming pool cover over a body of water in a swimming pool with tracks of the assembly in a position where they would be generally flush with the deck of the swimming pool, said assembly comprising:

a) a pair of spaced apart elongate tracks with each track adapted for mounting to one of the opposite sides of the swimming pool in generally parallel relationship;

b) a cable receiving channel in each of said elongate tracks;

c) a separate slider extending into a separate cable receiving channel in each of said pair of tracks for sliding movement therein and adapted to cause a pulling of the leading edge of the swimming pool cover;

d) a separate rigid body mounted on and being movable with each said slider and operatively carrying with it the leading edge of the swimming pool cover; and e) adjusting means to enable an adjustable sliding movement of the rigid body relative to the slider during movement of the slider at each track to reduce any twisting moment during pulling of the cover and thereby reduce any possibility of jamming.

8. The track and slider assembly of claim 7 further characterized in that each said track has an elongate slit in communication with said cable receiving channel of that track to receive the slider.

9. The track and slider assembly of claim 8 further characterized in that said each track is provided with mounting means for mounting the track in a position where it is essentially flush with a surface of the deck surrounding a body of water.

10. The track and slider assembly of claim 8 further characterized in that each said track comprises:

a) an elongate track-forming strip;

b) an upper plate on each elongate strip;

c) said cable receiving channel of each track is located beneath said upper plate of that track; and d) a cable return channel is also associated with each said track to receive a return cable capable of moving the flexible cover.

11. The track and slider assembly of claim 7 further characterized in that said cable receiving channel comprises a bulbous portion to receive a somewhat similarly shaped tube on the slider.

12. The track and slider assembly of claim 8 further characterized in that the opening of each track is offset to one side of said cable receiving channel, and that said slider associated with that track extends into said cable receiving channel at an angle which is angularly offset from a vertical direction which moving in said cable receiving channel.

13. The track and slider assembly of claim 8 further characterized in that:

a) a recess is located beneath said cable receiving channel in each track and forms a gutter to collect debris which can be moved to one end of the track and removed; and b) an opening extends between said channel and said gutter in each track enabling debris which enters said channel to drop into said gutter by the force of gravity and by movement of a cable in said cable receiving channel so that the debris will not interfere with movement of the slider in the track.

14. The track and slider assembly of claim 12 further characterized in that said slider extends at about a 45° angle relative to a vertical direction and that a slit is on one side of said track and said opening is on another side of said track so that the slit and opening lie in a common plane which is located at about a 45° angle relative to a vertical direction.

15. The track and slider assembly of claim 14 further characterized in that the adjusting means to enable an adjustable sliding movement comprises an elongate pin receiving slot in one of said rigid body or slider and a pin on the other to enable a slidable movement between the body and the slider.

16. The track and slider assembly of claim 15 further characterized in that wheel means is mounted on said body for riding on a flat surface and the adjusting means enables an adjustable sliding movement and also allows for adjustment of the relationship of the wheel means to the track.

17. A track and slider assembly for allowing sliding movement of a leading edge of a swimming pool cover over a body of water in a swimming pool with a pair of spaced apart tracks of the assembly in a position where they would be located at the deck of the swimming pool, said assembly comprising:

a) mounting means for mounting each of the pair of spaced apart elongate tracks with each track adapted for mounting to one of a pair of opposite sides of the swimming pool in generally parallel relationship;

b) a cable receiving channel in each of said elongate tracks;

c) a separate slider extending into a separate cable receiving channel in each of said tracks at approximately an acute angle therein for sliding movement therein and adapted to cause a pulling of the leading edge of the swimming pool cover;

d) a separate slider body mounted on and being movable with each said slider and carrying with it the leading edge of the swimming pool cover;

e) A gutter in each said track located generally beneath the cable receiving channel of that track to receive and collect debris that may land in the cable receiving channel and which will fall into the gutter beneath the cable receiving channel by the force of gravity and agitation through movement of the cable; and f) an opening existing between said gutter and said cable receiving channel with said opening lying in a plane extending through said slider so that the slider and opening are located relation to one another at about a 45° angle relative to the vertical and to the track.

18. The track and slider assembly of claim 17 further characterized in that first attachment means are provided at each said track to enable an adjustable sliding movement of the slider body relative to the slider during movement of the slider at each track to reduce any twisting moment during pulling of the cover and thereby reduce a possibility of jamming.

19. The track and slider assembly of claim 18 further characterized in that second adjustment means are provided for adjusting the position of the slider relative to the deck.

20. A track and slider assembly for allowing sliding movement of a leading edge of a swimming pool cover over a body of water in a swimming pool with first and second spaced apart elongate tracks of the assembly located at the deck of the swimming pool, said assembly comprising:

a) mounting means on each said first and second pair of spaced apart elongate tracks with each track adapted for mounting to one of the opposite sides of the swimming pool in generally parallel relationship;

b) a cable receiving channel in said first track;

c) a slider extending into said cable receiving channel in said first track for sliding movement therein and adapted to cause a pulling of the leading edge of the swimming pool cover;

d) a rigid body mounted on and being movable with said slider and operatively carrying with it the leading edge of the swimming pool cover; and e) first adjusting means to enable an adjustable sliding movement of the rigid body relative to the slider during movement of the slider at said first track to reduce any twisting moment during pulling of the cover and thereby reduce any possibility of jamming.

21. The track and slider assembly of claim 20 further characterized in that said each track is provided with mounting means for mounting the track in a position where it is essentially flush with a surface of the deck surrounding a body of water.

22. The track and slider assembly of claim 20 further characterized in that each said track comprises:

a) an elongate track-forming strip;

b) an upper plate on each elongate strip;

c) a cable receiving channel in each track which is located beneath said upper plate;

d) a cable return channel also associated with each said track to receive a return cable capable of moving the flexible cover; and e) an elongate slit in each said track in communication with said cable receiving channel of that track to receive the slider.

23. The track and slider assembly of claim 20 further characterized in that second adjusting means enables a slidable movement of the rigid body relative to the deck.

24. The track and slider assembly of claim 20 further characterized in that a bracket is mounted at said deck and protrudes relative to the body of water, and said rigid body is mounted on and adjustably positionable on said bracket.

25. The track and slider assembly of claim 22 further characterized in that said second adjusting means enables a slidable movement of the rigid body relative to the deck.

26. The track and slider assembly of claim 20 further characterized in that roller means is mounted on said body and enables a rolling movement of the leading edge of the swimming pool cover.

27. A track for use with a flexible enclosure cover allowing movement of the flexible enclosure cover over an area to be enclosed and which track allows for collection of debris, said track comprising:

a) an elongate strip with means for mounting adjacent an edge of the area to be covered;

b) a cable receiving channel in said elongate strip and sized to receive a cable adapted to move the flexible cover as the cable is moved;

c) a somewhat cylindrically shaped bulbous portion in said cable receiving channel sized to receive a cable for shifting movement therein;

d) cover attaching means for connecting the cable to the cover;

e) an elongate slit at the upper end of said cable receiving channel to receive the cover attaching means and being offset to one side of the bulbous portion of the cable receiving channel;

f) a recess located beneath said cable receiving channel and forming a gutter to collect debris and which is allowed to fall from the cable receiving channel into the gutter by force of gravity and by agitation through movement of the cable, and where the debris collected in the gutter can be moved to one end of the track and readily removed; and g) an opening between said channel and said gutter enabling debris which enters said channel to drop by force of gravity and agitation through movement of the cable into said gutter so that the debris will not interfere with movement of the cable in the cable receiving channel of the track.

28. The track of claim 27 further characterized in that the flexible cover is a swimming pool cover and the area to be enclosed is a body of water in the swimming pool.

29. The track of claim 20 further characterized in that gutter of said track is arcuately shaped.

30. A track for use with a flexible enclosure cover allowing movement of the flexible enclosure cover over an area to be enclosed and which track allows for collection of debris, said track comprising:

a) an elongate strip with means for mounting adjacent an edge of the area to be covered;

b) a cable receiving channel in said elongate strip and sized to receive a cable adapted to move the flexible cover as the cable is moved;

c) a recess located beneath said cable receiving channel and forming a gutter to collect debris and which can be moved to one end of the track and readily removed;

d) an opening between said channel and said gutter enabling debris which enters said channel to drop into said gutter so that the debris will not interfere with movement of the cable in the cable receiving channel of the track; and e) a plurality of axially extending lubricating fluid receiving grooves in said cable receiving channel.

* * * * *